US006168328B1

(12) United States Patent
Ueda et al.

(10) Patent No.: US 6,168,328 B1
(45) Date of Patent: Jan. 2, 2001

(54) THERMAL TRANSFER PRINTER WITH A PLURALITY OF CASSETTE HOLDER PLATES

(75) Inventors: Kazuo Ueda, Kanagawa-ken; Hideki Yorozu; Yoshibumi Abe, both of Iwate-ken, all of (JP)

(73) Assignee: Alps Electric Co., Ltd., Tokyo (JP)

( * ) Notice: Under 35 U.S.C. 154(b), the term of this patent shall be extended for 0 days.

(21) Appl. No.: 09/338,196

(22) Filed: Jun. 22, 1999

(30) Foreign Application Priority Data

Jul. 1, 1998 (JP) ..... 10-186128
Aug. 5, 1998 (JP) ..... 10-221484

(51) Int. Cl.[7] ..... B41J 35/22
(52) U.S. Cl. ..... 400/206; 400/206.2; 400/206.3
(58) Field of Search ..... 400/206, 206.1, 400/206.2, 206.3, 171, 196, 207, 208, 208.1, 250, 692; 347/214

(56) References Cited

U.S. PATENT DOCUMENTS 5,538,351 * 7/1996 Miyano ..... 400/206
5,720,562 * 2/1998 Ogawa ..... 400/208
5,739,839 * 4/1998 Iwai et al. ..... 347/214
5,777,652 * 7/1998 Takeuchi ..... 400/206
5,951,176 * 9/1999 Ueda et al. ..... 400/206

FOREIGN PATENT DOCUMENTS 0 860 292 A2 * 8/1998 (EP) .
2-103174 * 4/1990 (JP) .

* cited by examiner

*Primary Examiner*—John S. Hilten
*Assistant Examiner*—Daniel J. Colilla
(74) *Attorney, Agent, or Firm*—Brinks Hofer Gilson & Lione

(57) ABSTRACT

According to the thermal transfer printer, a plurality of cassette holder plates each for holding ribbon cassettes stacked in plural stages are arranged side by side on a holding cover on the side opposed to a carriage, a fixed holding arm for holding the ribbon cassettes and a movable holding arm for pressing the ribbon cassettes toward the fixed holding arm are disposed respectively on both sides of each cassette holder plate of the holding cover, holding guides are erected on the holding cover at positions corresponding to ribbon cores of the ribbon cassettes in such a manner as to extend through the cassette holder plate, and a holding arm for holding the peripheral edge portion of one ribbon core of each ribbon cassette is formed integrally with one holding guide, while ribs for engagement with the other ribbon core of the ribbon cassette are formed on the other holding guide.

6 Claims, 10 Drawing Sheets

THERMAL TRANSFER PRINTER WITH A PLURALITY OF CASSETTE HOLDER PLATES

BACKGROUND OF THE INVENTION

1. Field of the Invention

The present invention relates to a thermal transfer printer provided with a mechanism for performing a ribbon cassette transfer operation between a carriage and a cassette holder plate. A ribbon cassette containing an ink ribbon of a desired color is loaded onto the carriage automatically, thereby permitting image recording to be effected using the ink ribbon of the desired color.

2. Description of the Prior Art

Generally, thermal transfer recording devices such as thermal transfer printers are popular as output devices such as computers and word processors by reason of high recording quality, low noise, low cost and easy maintenance.

According to the construction of such conventional thermal transfer recording devices, a carriage is disposed so that it can reciprocate along a platen, a thermal head is mounted on the carriage, and a ribbon cassette containing an ink ribbon of a desired color is loaded onto the carriage removably. The thermal head is driven in accordance with image information while taking up the ink ribbon in the ribbon cassette, whereby a desired image recording is performed on a recording paper which is fed between the platen and the thermal head.

Recently, in such a thermal transfer recording device, a full-color image recording has been conducted using ribbon cassettes containing ribbon cassettes of, that is, four colors of yellow, magenta, cyan and black.

In this case, according to the prior art, when recording of a certain color is to be performed, the user is required to make a change to a ribbon cassette of that color. But the cassette changing work is very troublesome and may cause an error in the selection of color. Thus, it has so far been impossible to effect a full-color image recording in a rapid, easy and reliable manner.

In an effort to eliminate such an inconvenience there has recently been developed a thermal transfer printer wherein four-color ribbon cassettes of yellow, magenta, cyan and black are held side by side on a frame of the printer and are loaded onto a carriage selectively in accordance with recording information, thereby permitting a change from one ribbon cassette to another. According to this printer, a full-color image recording can be done rapidly and that reliably.

In the above thermal transfer printer, a certain number of ribbon cassettes can be changed from to another automatically. However, recently a wide variety of inks have come to be used such as, for example, metallic inks, lustrous inks or overprint inks. In the conventional printer a limit is encountered in the number of ribbon cassettes capable of being held side by side. Thus, it has become impossible to fully cope with the use of such a wide variety of inks, giving rise to the problem that ribbon cassettes containing ink ribbons of various colors cannot be changed from one to another automatically.

SUMMARY OF THE INVENTION

The present invention has been accomplished in view of the above-mentioned points and it is an object of the invention to provide a thermal transfer printer wherein a larger number of ribbon cassettes than in the conventional thermal transfer printer can be held properly and a ribbon cassette containing an ink ribbon of a required color can be selected from among those ribbon cassettes and be loaded onto a carriage automatically.

It is another object of the present invention to provide a thermal transfer printer comprising: a carriage with a thermal head mounted thereon and which can reciprocate along a platen; a ribbon take-up mechanism for taking up an ink ribbon of a ribbon cassette loaded onto the carriage; a holding cover disposed at a position opposed to the carriage; a plurality of cassette holder plates for holding ribbon cassettes respectively, the cassette holder plates being arranged side by side on the holding cover on the side opposed to the ribbon cassette holding side of the carriage; and a carrier disposed on the carriage for the transfer and replacement of the ribbon cassettes between the cassette holder plates and the carriage. A ribbon cassette containing an ink ribbon of a desired color is selected and loaded onto the carriage, the thermal head is driven in accordance with image information to effect a desired recording on a recording paper fed between the platen and the thermal head. The cassette holder plates can hold the ribbon cassettes stacked in two stages, and the total number of ribbon cassettes held on all the cassette holder plates is smaller by at least one than the total number of ribbon cassettes capable of being held by the cassette holder plates. When the lower-stage ribbon cassette out of the ribbon cassettes held in two stages on each cassette holder plate is to be taken out, the upper-stage ribbon cassette can be retracted on a vacant stage of another cassette holder plate and thus the ribbon cassettes held on the cassette holder plates can be loaded selectively onto the carriage.

It is a further object of the present invention to provide a thermal transfer printer wherein the cassette holder plates are movable vertically, and an urging means is provided for urging the cassette holder plates so as to be positioned on the carriage side at all times, whereby even when only one ribbon cassette is held on a cassette holder plate, the ribbon cassette can be transferred easily onto the carriage because it is positioned on the carriage side.

It is a still further object of the present invention to provide a thermal transfer printer wherein on both sides of each cassette holder plate are disposed respectively a fixed holding arm for holding the ribbon cassettes on the cassette holder plate and a movable holding arm for pressing the ribbon cassettes to the fixed holding arm side, holding guides are erected on the holding cover so as to extend through the cassette holder plates at positions corresponding to ribbon cores of the ribbon cassettes, a holding arm for holding the peripheral edge portion of one ribbon core of each ribbon cassette is formed integrally with one holding guide for each cassette holder plate, and a rib for engagement with the other ribbon core of the ribbon cassette is formed on the other holding guide. Whereby the rotation of the ribbon cores of the ribbon cassette held on each cassette holder plate can be prevented and hence it is possible to prevent the occurrence of slack, etc. of the ink ribbon.

It is a still further object of the present invention to provide a thermal transfer printer wherein the tip of the fixed holding arm and that of the holding arm of one holding guide are respectively formed with pawls for holding the ribbon cassette, the pawls projecting in the same direction, and the rib of the other holding guide is also projected in the same direction. With a force exerted in one direction, not only the ribbon cassette can be held firmly, but also the rotation of the ribbon cores can be prevented.

It is a still further object of the present invention to provide a thermal transfer printer wherein the projecting direction of the tip of the fixed holding arm and that of the holding arm of one holding guide and the projecting direction of the rib of the other holding guide are made opposite to the pressing direction of the movable holding arm for the ribbon cassette. With a unidirectional pressing force of the movable holding arm, not only the ribbon cassette can be held firmly but also the rotation of the ribbon cores can be prevented.

It is a still further object of the present invention to provide a thermal transfer printer wherein the rib of the other holding guide is engaged with the take-up core of the ribbon cassette. While the ribbon cassette is held on the cassette holder plate, it is possible to prevent rotation of the take-up side ribbon core and prevent the occurrence of slack, etc. of the ink ribbon. Further, it is possible to surely prevent the occurrence of a recording error or the like which is attributable to dislocation to a recorded area of an already ink-transferred (recorded) ink ribbon portion.

It is a still further object of the present invention to provide a thermal transfer printer wherein swivel-stop bosses for engagement with the ribbon cores of the ribbon cassette are formed projectingly on each cassette holder plate to prevent rotation of the ribbon cores and thereby prevent slackening or the like of the ink ribbon.

DETAILED DESCRIPTION OF THE PREFERRED EMBODIMENTS

Figure 1:
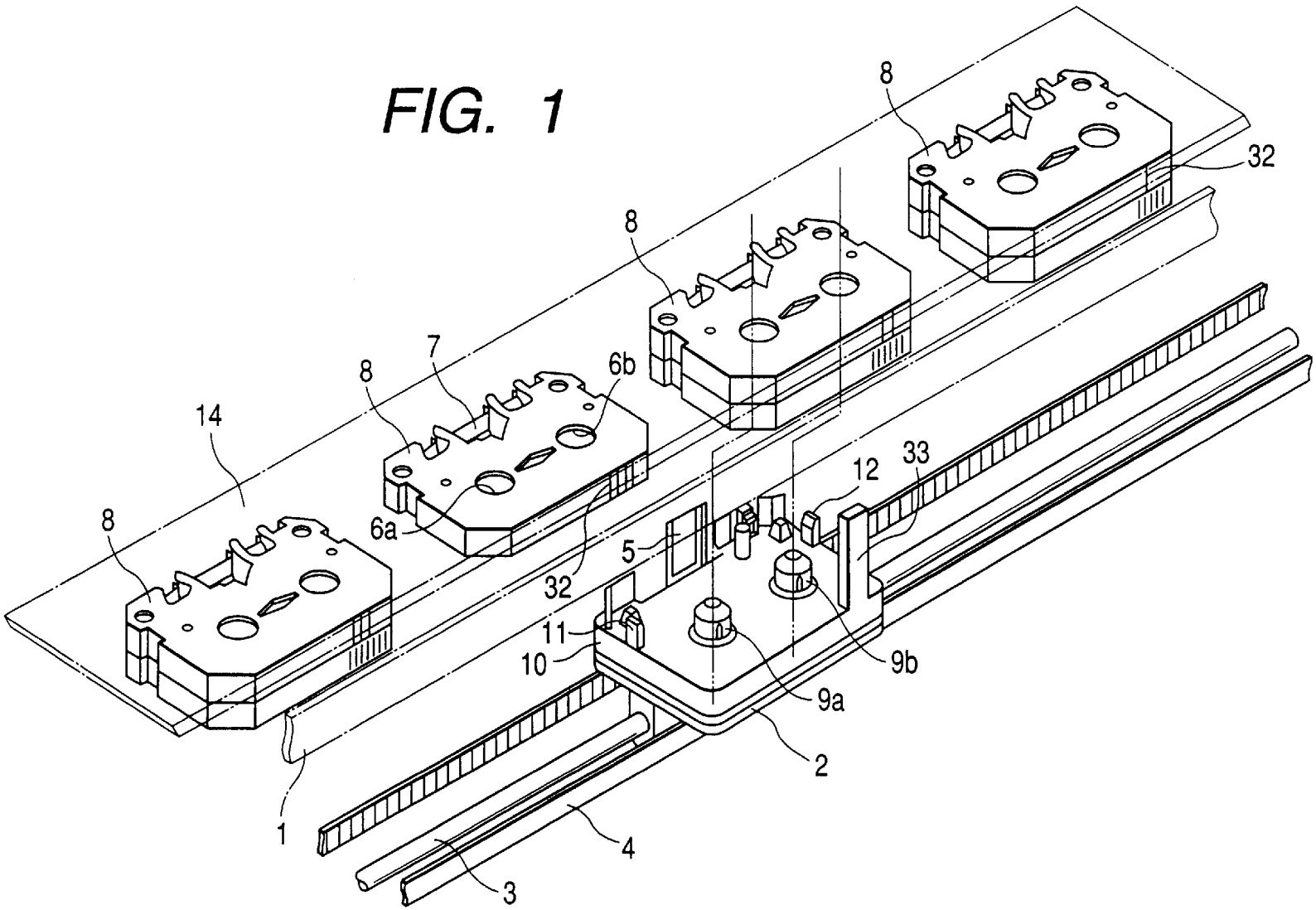
FIG. 1 is a schematic perspective view of a thermal transfer printer according to an embodiment of the present invention.

Embodiments of the present invention will be described hereinunder with reference to FIGS. 1 to 26.

Referring to FIGS. 1 to 4, there is illustrated a thermal transfer printer embodying the present invention. A flat plate-like platen 1 is disposed on a printer frame so that a printing surface thereof faces upward, and a carriage 2 is disposed above the platen 1 so that it can reciprocate along a guide shaft 3 and in parallel with the platen 1. A driving belt 4, which is wound round a pair of pulleys (not shown), is connected to the carriage 2. The driving belt 4 is driven through the pulleys by means of a drive unit (not shown) such as a stepping motor, whereby the carriage 2 is reciprocated along the guide shaft 3.

A thermal head 5 is attached to the carriage 2 opposedly to the platen 1 and movably into contact with and away from the platen. The thermal head 5 has a plurality of heat generating elements (not shown) arranged in a row and adapted to generate heat selectively in accordance with desired printing information. A take-up bobbin 9*a* for taking up an ink ribbon 7 of a ribbon cassette 8 and a delivery bobbin 9*b* for delivery of the ink ribbon 7 are disposed rotatably on the carriage 2. The ribbon cassette 8 contains an ink ribbon 7 of a predetermined color which is wound round both take-up ribbon core 6*a* and delivery ribbon core 6*b*, and the take-up bobbin 9*a* and the delivery bobbin 9*b* are engaged with the ribbon cores 6*a* and 6*b*, respectively.

A carrier 10 is disposed on the upper surface of the carriage 2 so that the carrier 10 can be moved perpendicularly into contact with and away from the carriage upper surface by means of a drive mechanism (not shown), with the ribbon cassette 8 being loaded onto the carrier 10 removably. On both sides of the carrier 10 are respectively disposed a fixed carrier arm 11 and a movable carrier arm 12 which is pivotable in the transverse direction, with holding pawls 13 being formed at the tips of the fixed carrier arm 11 and the movable carrier arm 12 respectively.

Figure 2:
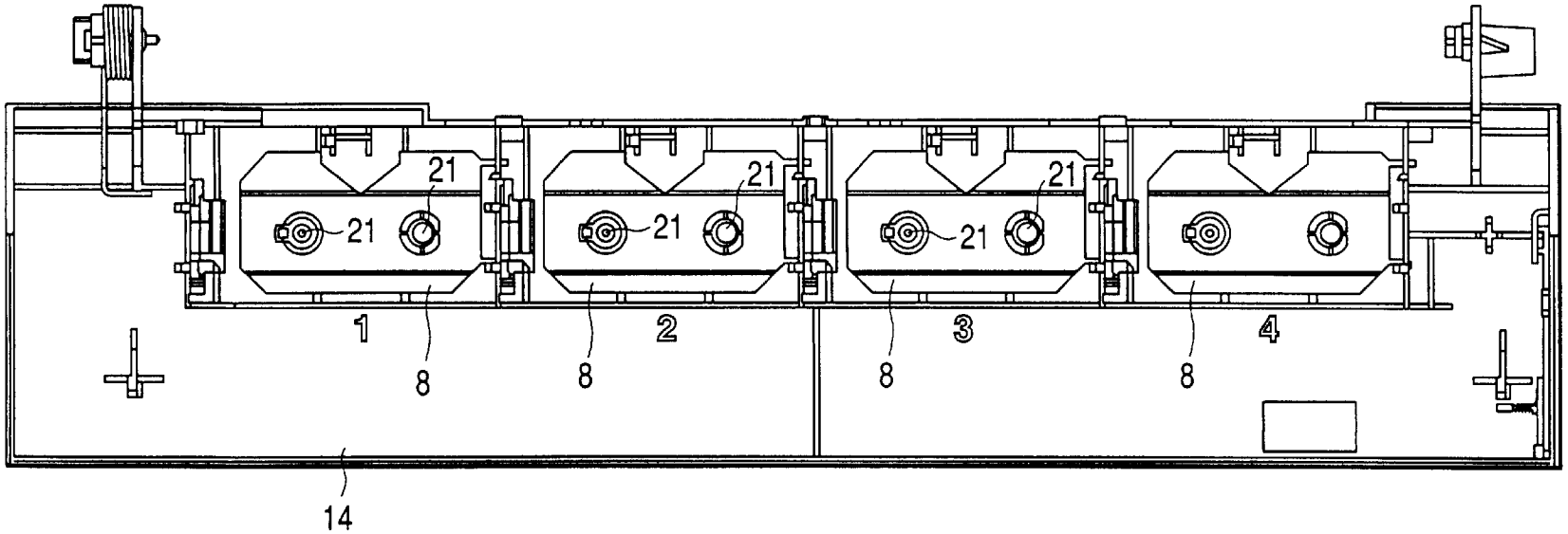
FIG. 2 is a plan view of a holding cover portion of the thermal transfer printer.

As shown in FIGS. 1 and 2, a holding cover 14 opposed to the carriage 2 is formed on the printer frame so as to be capable of being opened and closed and at an approximately the same length as the length of a traveling area of the carriage 2.

Figure 5:
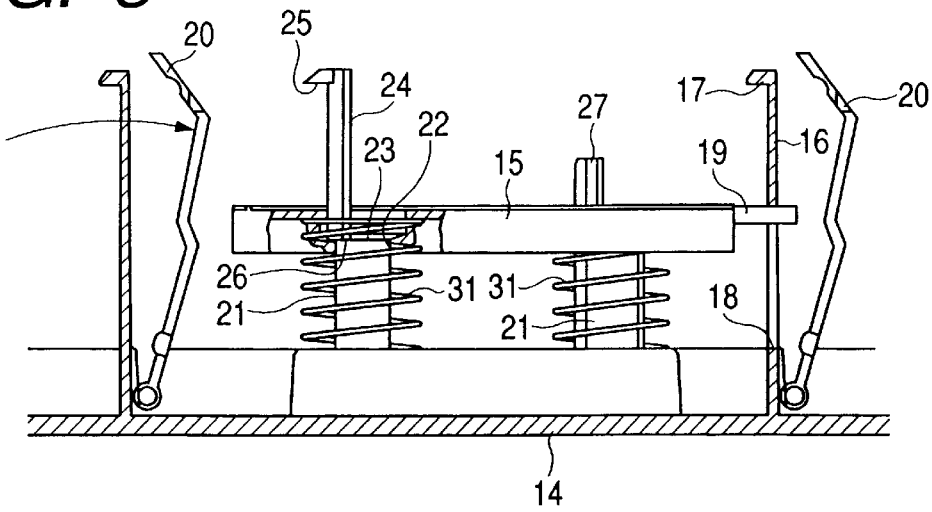
FIG. 5 is a partially sectional front view of a cassette holder plate portion used in the thermal transfer printer.
Figure 6:
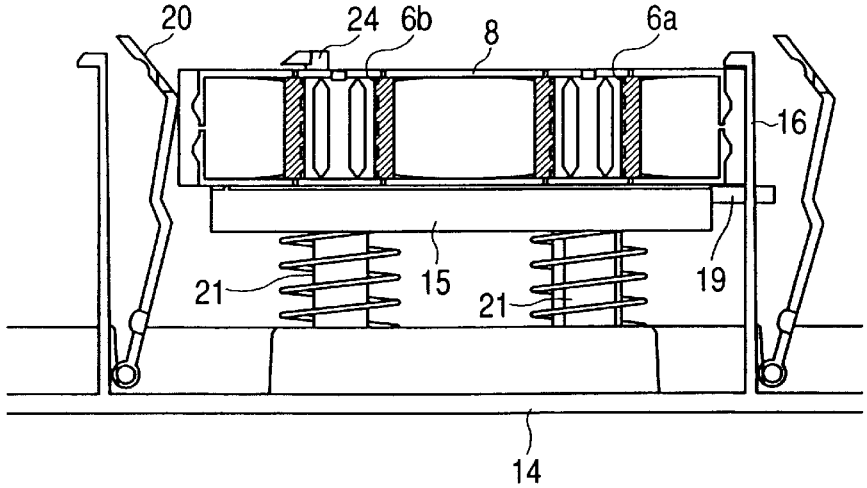
FIG. 6 is a partially sectional front view showing one ribbon cassette held on the cassette holder plate portion illustrated in FIG. 5.
Figure 7:
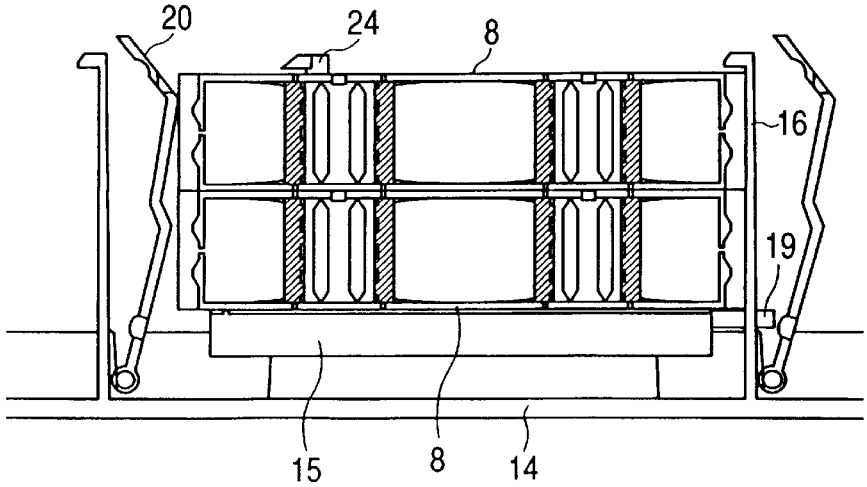
FIG. 7 is a partially sectional front view showing two ribbon cassettes held on the cassette holder plate portion illustrated in FIG. 5.

Further, as shown in FIGS. 5 to 7, a plurality (four in this embodiment) of cassette holder plates 15 for holding ribbon cassettes 8 are arranged side by side at predetermined positions of the holding cover 14 on the side opposed to the carriage 2, and two ribbon cassettes 8 can be held in two stages on each cassette holder plate 15. A fixed holding arm 16 having a length approximately equal to the stacked thickness of ribbon cassettes 8 is formed projectingly near one side of each cassette holder plate 15 on the holding cover 14. The tip of the fixed holding arm 16 is formed with a holding pawl 17 which is bent to the cassette holder plate 15 side so as to engage a side edge portion of each ribbon cassette 8. Further, the fixed holding arm 16 is formed with stopper grooves 18 extending longitudinally from the base end portion of the fixing holding arm, and engaging pins 19 for engagement with the stopper grooves 18 are projected from the cassette holder plate 15 on the side opposed to the fixed holding arm 16. The stopper grooves 18 are formed in such a manner that their upper ends are located at a position at which the spacing between the upper surface of the cassette holder plate 15 and the inside of the holding pawl 17 is almost equal to or slightly smaller than the thickness of one ribbon cassette 8 in an engaged state of the engaging pins 19 of the cassette holder plate 15 with the upper ends of the stopper grooves 18. This is because if the spacing between the upper surface of the cassette holder plate 15 and the inside of the holding pawl 17 is formed larger than the thickness of one ribbon cassette 8, there increases wobbling when only one ribbon cassette 8 is to be held, and the ribbon cassette cannot be held accurately by the cassette holder plate 15 and the holding pawl 17 of the fixed holding arm. Moreover, if the upper surface of the cassette holder plate 15 is made movable up to near the inside of the holding pawl 17, a large urging force is required to urge the cassette holder plate. Therefore, not only a large force is required at the time of depressing the cassette holder plate 15 in ribbon cassette replacement, but also the ribbon cassette 8 is kept engaged with the holding pawl 17 with a strong force, thus leading to deterioration in durability of the ribbon cassette case and the holding paws 17.

Near the opposite side of each cassette holder plate 15 on the holding cover 14 is mounted a movable holding arm 20 so as to be pivotable about its base end portion. With the biasing force of a biasing spring (not shown), the movable holding arm 20 is urged for pivotal motion toward the cassette holder plate 15 at all times. The tip of the movable holding arm 20 is bent for abutment with a side edge portion of the ribbon cassette 8 positioned on the upper-stage side.

At the position corresponding to each cassette holder plate 15 on the holding cover 14 are erected two holding guides 21 in a corresponding relation to the ribbon cores 6*a* and 6*b* of the ribbon cassette 8, and in the cassette holder plate 15 are formed two through holes 22 at positions corresponding to the holding guides 21 of the cassette holding plate. As shown in FIG. 5, of the two through holes 22, the one positioned on the movable holding arm 20 side is formed in a concave shape so as to extend in the circumferential direction thereof, and a retaining surface 23 is formed above the concave portion.

Of the holding guides 21, the one positioned on the movable holding arm 20 side is integral with an upwardly extending holding arm 24, and at the tip of the holding arm 24 is formed a retaining pawl 25 which is bent toward the movable holding arm 20. At the base end portion of the holding arm 24 is formed a stepped portion 26 which is displaced so as to slightly project radially outwards with respect to the holding guide 21. By engagement of the stepped portion 26 with the retaining surface 23 of the associated through hole 22 formed in the cassette holder plate 15, an upward movement of the cassette holder plate is restricted.

Figure 8:
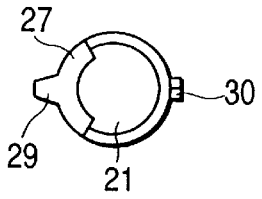
FIG. 8 is a plan view showing a holding guide.
Figure 9:
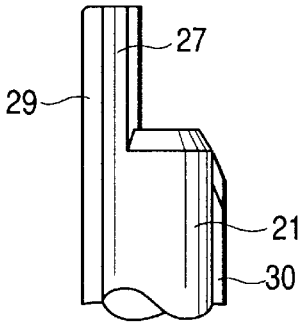
FIG. 9 is a front view thereof.
Figure 10:
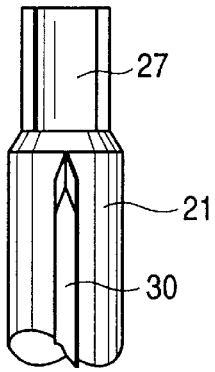
FIG. 10 is a side view thereof.

As to the holding guide 21 positioned on the fixed holding arms 16 side, as shown in FIGS. 8 to 10, the tip edge thereof on the movable holding arm 20 side is extended upward to form an extending portion 27 integrally, and at side faces of this holding guide 21 and the extending portion 27 on the movable holding arm 20 side there is formed a first rib 29 for engagement with ribs 28 formed vertically on the inner peripheral surface of a take-up ribbon core 6*a*. At the side face of the holding guide 21 on the fixed holding arm 16 side is vertically formed a second rib 30 for engagement with the ribs 28 formed on the inner peripheral surface of the take-up ribbon core 6*a*.

Around each holding guide 21 is disposed a biasing spring 31 for urging the cassette holder plate 15 upward at all times. In a normal state, with the biasing force of the biasing springs 31, the stepped portion 26 of the holding arm 24 comes into engagement with the retaining surface 23 of one through hole 22 formed in the cassette holder plate 15, and the engaging pins 19 are maintained in an engaged state with the upper ends of the stopper grooves 18. When a depressing force is applied to the cassette holder plate 15, the same plate is moved along the holding guides 21 against the biasing force of the biasing springs 31.

Figure 3:
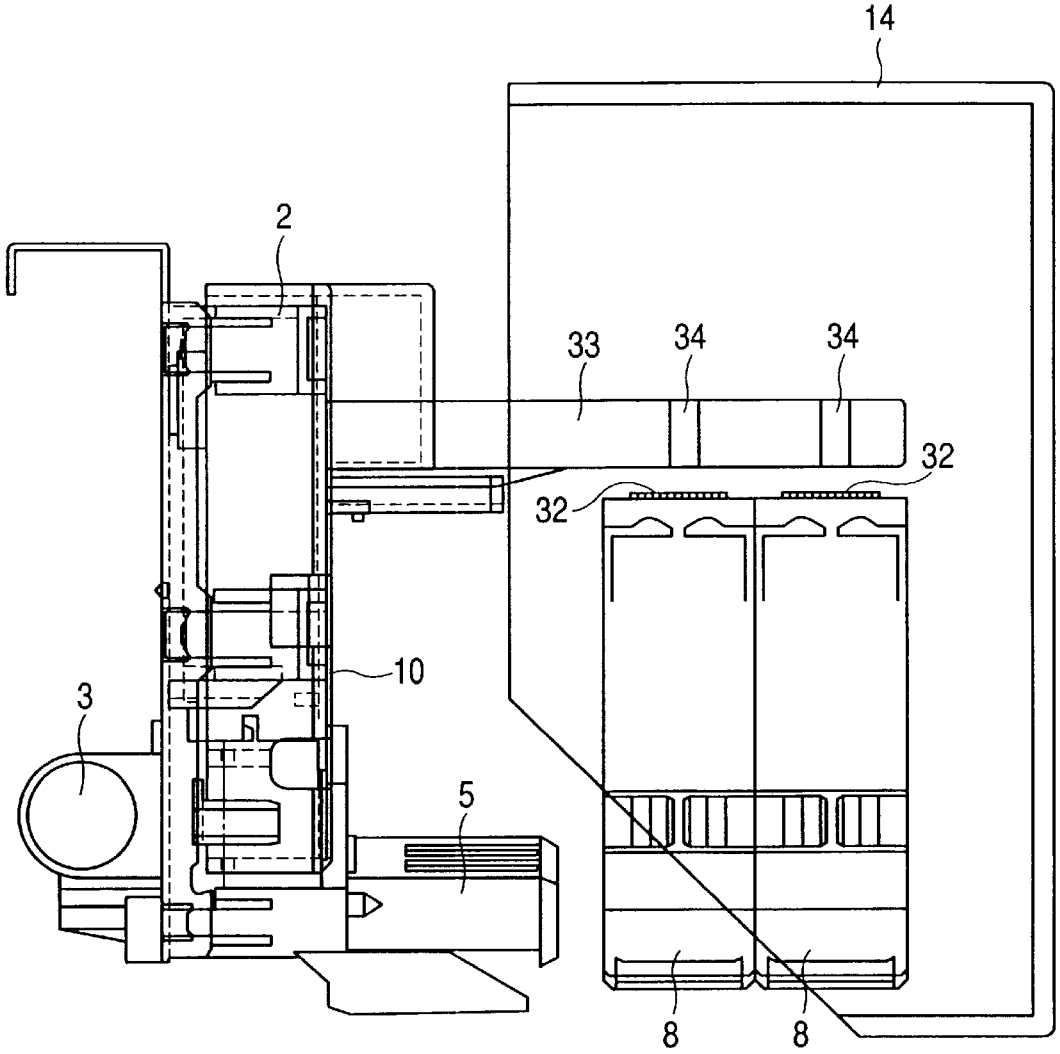
FIG. 3 is a side view of the thermal transfer printer in a normal state.
Figure 4:
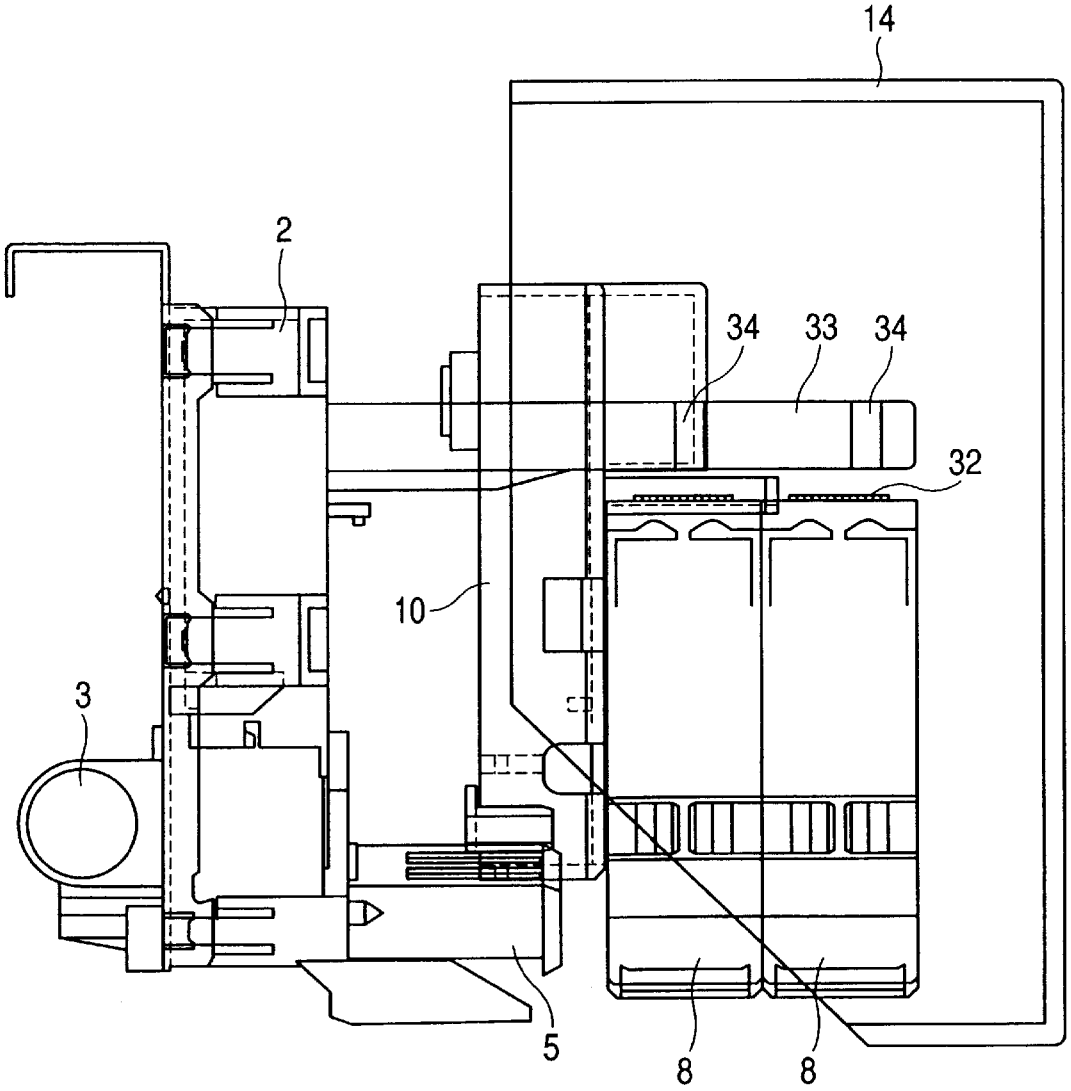
FIG. 4 is a side view showing a spaced state of a carrier used in the thermal transfer printer.

In this embodiment, as shown in FIGS. 1, 3 and 4, an identification mark 32 is formed on the rear side of the ribbon cassette 8. The identification mark 32 is different for each type of ink ribbon 7 so that the type of the ink ribbon contained in each ribbon cassette 8 can be identified. A sensor support 33 is erected on the carriage 2 at an end edge of the carriage remote from the platen 1 and two optical sensors 34 for detecting the identification marks 32 of ribbon cassettes 8 held in two stages are disposed on the sensor support 33 at positions corresponding to the rear sides of the ribbon cassettes 8.

The operation of this embodiment will be described below.

Before performing a predetermined printing, ribbon cassettes 8 are loaded onto the cassette holder plates 15 on the holding cover 14.

More specifically, each ribbon cassette 8 is loaded onto each cassette holder plate 15 while allowing the movable holding arm 20 to pivot against the urging force thereof in such a manner that the delivery ribbon core 6*b* of the ribbon cassette is fitted on the extending portion 27 and that care is taken to prevent a side face of the ribbon cassette 8 from abutting the holding pawl 17 of the fixed holding arm 16. Once the ribbon cassette 8 is placed on the upper surface of the cassette holding plate 15, the movable holding arm 20 presses a side face of the ribbon cassette 8 by virtue of its urging force, so that the opposite-side upper edge of the ribbon cassette is brought into engagement with the holding pawl 17 of the fixed holding arm 16 and at the same time the engaging pawl 25 of the holding arm 24 is brought into engagement with the peripheral edge portion of the delivery ribbon core 6*b* of the ribbon cassette 8. In this way the ribbon cassette 8 as the first ribbon cassette is held, as shown in FIG. 6.

Next, as shown in FIG. 7, another ribbon cassette 8 as the second ribbon cassette is loaded in the same manner as above onto the cassette holder plate 15 with the first ribbon cassette 8 already loaded thereon. As a result, the ribbon cassette 8 which has already been loaded is depressed and the cassette holder plate 15 is moved down along the holding guides 21 with the biasing force of the biasing springs 31, whereby the upper edge of the upper-stage ribbon cassette 8 is engaged with the holding pawl 17 of the fixed holding arm 16 and the engaging pawl 25 of the holding arm 24 is engaged with the peripheral edge portion of the delivery ribbon core 6*b* of the ribbon cassette 8. In this way the first and second ribbon cassettes are held in two stages.

Figure 11:
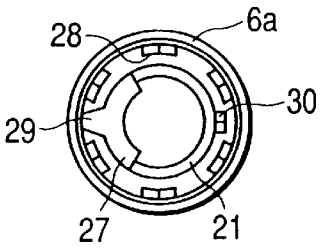
FIG. 11 is a plan view showing a relation between a holding guide and a ribbon core of an upper-stage ribbon cassette in the state illustrated in FIG. 7.
Figure 12:
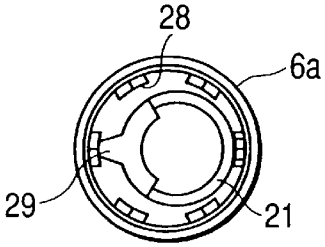
FIG. 12 is a plan view showing another relation between the holding guide and a ribbon core of the upper-stage ribbon cassette in the state illustrated in FIG. 7.

In this case, as shown in FIG. 11, the upper-stage ribbon cassette 8 is urged toward the fixed holding arm 16 by the movable holding arm 20. The first rib 29 on the extending portion 27 of the holding guide 21 positioned on the fixed holding arm 16 side is engaged between ribs 28 formed on the inner peripheral surface of the take-up ribbon core 6*a* of the ribbon cassette 8, the core 6*a* is prevented from rotation. In a case where the first rib 29 comes into direct abutment with the ribs 28 of the take-up ribbon core 6*a,* depending on the state of rotation of the same core, the take-up core is pressed by the first rib 29, as shown in FIG. 12, whereby the rotation of the take-up core can also be prevented.

Figure 13:
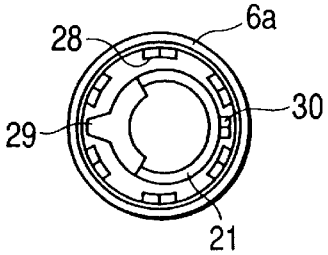
FIG. 13 is a plan view showing a relation between the holding guide and a ribbon core of a lower-stage ribbon cassette in the state illustrated in FIG. 7.

Although the lower-stage ribbon cassette 8 is not urged by the movable holding arm 20, the first and second ribs 29, 30 of the holding guide 21 are each engaged between ribs 28 of the take-up ribbon core 6*a* in the ribbon cassette 8, as shown in FIG. 13, whereby the take-up ribbon core is held so as not to rotate.

Thus, since the rotation of the take-up ribbon core 6*a* in the ribbon cassette 8 is prevented by the first and second ribs 29, 30 of the holding guide 21, the occurrence of slack or the like of the ink ribbon 7, which is caused by rotation of the core 6*a,* can be prevented while holding the ribbon cassette 8. Besides, since the rotation of the take-up ribbon core 6*a* is prevented, there is no fear that an ink-transferred portion of the ink ribbon 7 may be displaced to the recording portion. It is possible to surely prevent the occurrence of a printing error, etc.

Further, if there are n number of cassette holder plates 15 and two ribbon cassettes 8 can be loaded onto each cassette holder plate 15, a total of 2n−1 ribbon cassettes 8 are loaded onto the n number of cassette holder plates 15. Since four cassette holder plates 15 are used in this embodiment, a total of seven ribbon cassettes 8 are loaded. That is, a portion for retraction which permits one ribbon cassette 8 to be loaded is provided for once retracting an upper-stage ribbon cassette 8 when a lower-stage ribbon cassette 8 is to be used.

For printing, a color necessary for image printing is determined in accordance with image information which is inputted from, for example, a host computer or an image reader (neither shown), and a ribbon cassette 8 containing the ink ribbon 7 of the thus-determined color is detected. This is performed by using the optical sensors 34 which detect the identification marks 32 of the ribbon cassettes 8 held on the holding cover 14, while the carriage 2 is allowed to move. When the identification mark 32 of the ribbon cassette 8 containing the ink ribbon 7 of the desired color has been detected, the carriage 2 is stopped at the position corresponding to the ribbon cassette. In this embodiment, since two optical sensors 34 are disposed on the sensor support 33, the identification marks 32 of the ribbon cassettes 8 stacked in two stages on the holding cover 14 can be detected by a single scan.

Figure 14:
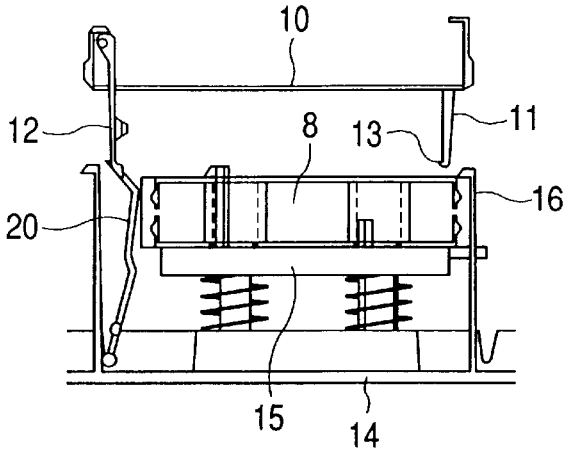
FIG. 14 is an explanatory diagram in a slightly spaced state of the carrier, showing a transfer operation of the carrier for one-stage ribbon cassette.
Figure 15:
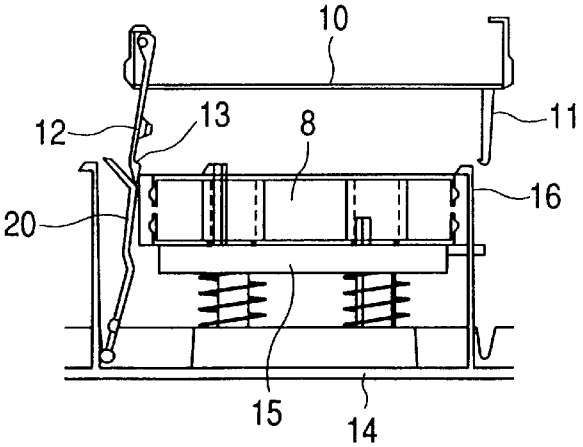
FIG. 15 is an explanatory diagram in a transversely moving state of the carrier, showing a transfer operation of the carrier for one-stage ribbon cassette.
Figure 16:
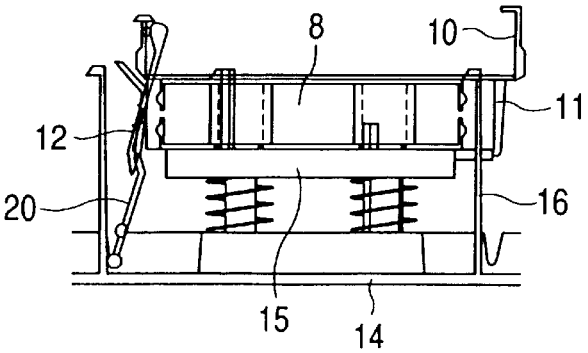
FIG. 16 is an explanatory diagram in a proximate state of the carrier to a ribbon cassette, showing a transfer operation of the carrier for one-stage ribbon cassette.
Figure 17:
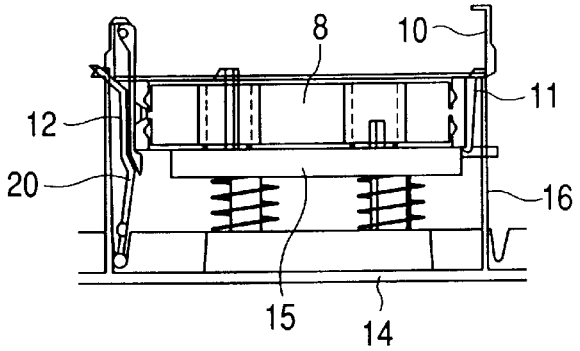
FIG. 17 is an explanatory diagram ina transversely moving state of the carrier, showing a transfer operation of the carrier for one-stage ribbon cassette.
Figure 18:
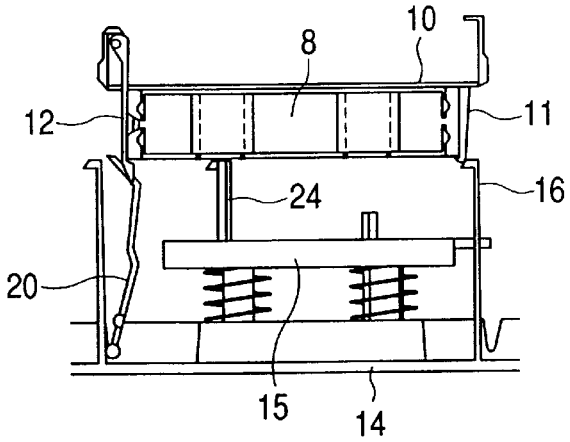
FIG. 18 is an explanatory diagram in a returned state of the carrier, showing a transfer operation of the carrier for one-stage ribbon cassette.
Figure 19:
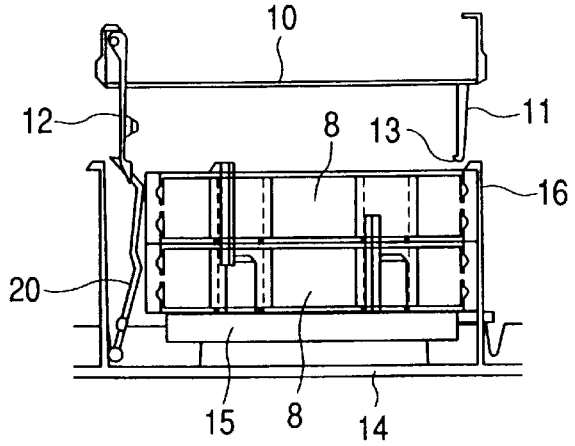
FIG. 19 is an explanatory diagram in a slightly spaced state of the carrier, showing a transfer operation of the carrier for two-stage ribbon cassettes.
Figure 20:
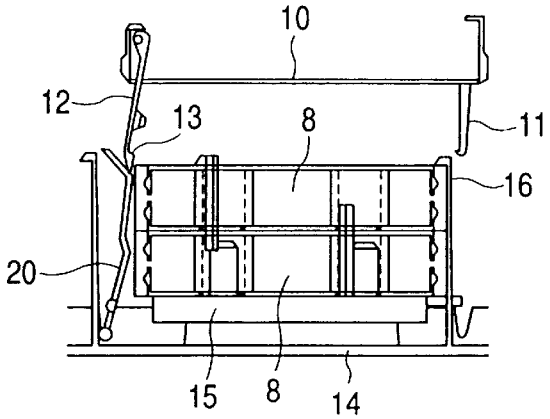
FIG. 20 is an explanatory diagram in a transversely moving state of the carrier, showing a transfer operation of the carrier for two-stage ribbon cassettes.
Figure 21:
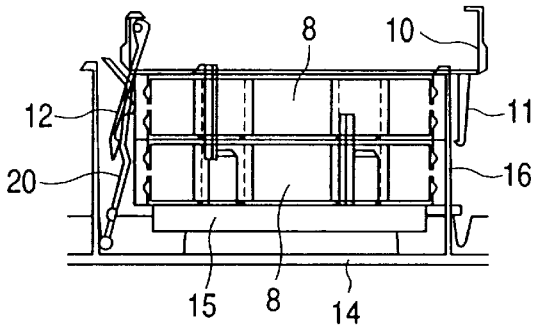
FIG. 21 is an explanatory diagram in a proximate state of the carrier to a ribbon cassette, showing a transfer operation of the carrier for two-stage ribbon cassettes.
Figure 22:
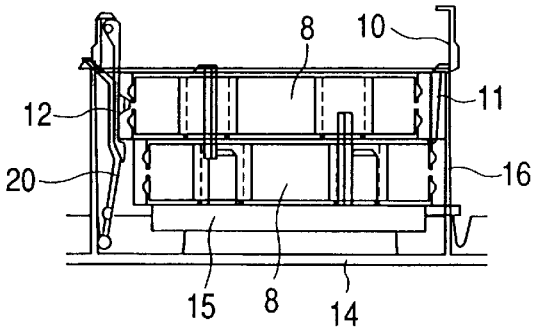
FIG. 22 is an explanatory diagram ina transversely moving state of the carrier, showing a transfer operation of the carrier for two-stage ribbon cassettes.

In this state, as shown in FIG. 14 or FIG. 19, the carrier 10 is moved away from the carriage 2, allowing the tip of the movable carrier arm 12 to reach a position where it abuts the upper edge of the associated ribbon cassette 8. Thereafter, the carrier 10 is moved in the transverse direction along the ribbon cassette 8, as shown in FIG. 15 or FIG. 20, whereby the movable carrier arm 12 is moved pivotally and the fixed carrier arm 11 is moved to a position beyond the opposite side of the ribbon cassette 8. In this state, as shown in FIG. 16 or FIG. 21, the carrier 10 is further moved away from the carriage 2 and toward the ribbon cassette 8, allowing the holding pawls 13 of the fixed carrier arm 11 and movable carrier arm 12 to be positioned at the lower edge of the ribbon cassette. Subsequently, as shown in FIG. 17 or FIG. 22, the carrier 10 is moved in the transverse direction, whereby the holding pawl 13 of the movable carrier arm 12 and that of the fixed carrier arm 11 are brought into engagement with both end edges of the underside of the ribbon cassette 8 to hold the cassette. Then, as shown in FIG. 18 or FIG. 23, the carrier 10 is operated for return, whereby the ribbon cassette 8 is loaded onto the carriage 2 through the carrier 10.

Then, the carriage 2 is reciprocated and the take-up bobbin 9*a* is rotated to take up the ink ribbon 7. At the same time, the thermal head 5 is driven in accordance with the inputted image information to effect printing in a desired color onto a printing paper which is fed between the platen 1 and the thermal head 5.

When the printing with the ink ribbon 7 of this color is over, the carriage 2 is stopped at a position opposed to the cassette holder plate 15 on which is held the ribbon cassette 8 used for printing.

Figure 23:
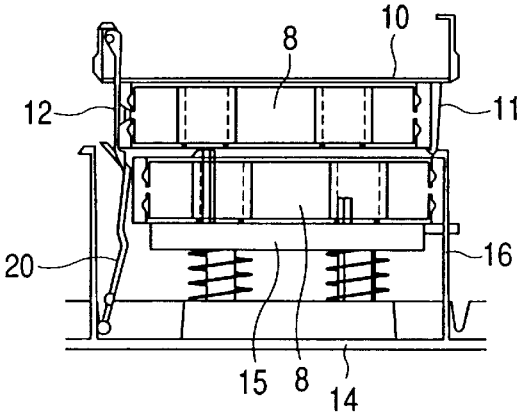
FIG. 23 is an explanatory diagram in a returned state of the carrier, showing a transfer operation of the carrier for two-stage ribbon cassettes.

Then, in the state shown in FIG. 18 or FIG. 23, the carrier 10 is moved away from the carriage 2, allowing the ribbon cassette 8 to approach the upper surface of the cassette holder plate 15, as shown in FIG. 17 or FIG. 22. Thereafter, the carrier 10 is moved in the transverse direction, as shown in FIG. 16 or FIG. 21. As a result, the holding pawl 13 of the fixed carrier arm 11 is disengaged from the lower edge of the ribbon cassette 8 and the holding pawl 13 of the movable carrier arm 12 is also disengaged from the lower edge of the ribbon cassette, which cassette is held on the cassette holder plate 15.

Then, the carrier 10 is operated for return as in FIG. 15 or FIG. 20 and is returned transversely as in FIG. 14 or FIG. 19, thereby causing the carrier 10 to return to the carriage 2.

Subsequently, in the same manner as above, the ribbon cassette 8 containing the ink ribbon 7 of a desired color is detected using the optical sensors 34, then the ribbon cassette thus detected is loaded onto the carriage 2, and printing is conducted using the ink ribbon 7 of the desired color.

The above operations are repeated successively for ribbon cassettes 8 containing the ink ribbons of desired colors to effect printing in desired colors.

If the ribbon cassette 8 containing the ink ribbon 7 of a required color is held in the lower stage on the cassette holder plate 15, the ribbon cassette 8 held in the upper stage is temporarily retracted to the portion for retraction by operation of the carrier 10, thus permitting the lower-stage ribbon cassette 8 to be taken out.

Thus, in this embodiment, ribbon cassettes in a number smaller by one than the total number of ribbon cassettes capable of being held on the cassette holder plates 15 are held on cassette holder plates, so even when the ribbon cassette 8 held in the lower stage out of ribbon cassettes held in two stages on each cassette holder plate 15 is to be taken out, the upper-stage ribbon cassette 8 can be retracted and all the ribbon cassettes 8 held on all the cassette holder plates 15 can be loaded selectively onto the carriage 2. Accordingly, even when ribbon cassettes 8 of various colors are held on the cassette holder plates, the ribbon cassettes can be changed from one to another automatically, whereby it is possible to effect printing of a full-color image rapidly and positively.

Moreover, since two optical sensors 34 are provided on the sensor support 33, the identification marks 32 of the ribbon cassettes 8 held in two stages on the holding cover 14 can be detected by a single scan.

Consequently, the operation for detecting the ribbon cassettes held in plural stages can be done rapidly and it is possible to effect speedup of the ribbon cassette changing operation.

Further, with each ribbon cassette 8 held on each cassette holder plate 15, the rotation of the take-up ribbon core 6*a* of the ribbon cassette 8 is prevented by the first and second ribs 29, 30 of the holding guide 21, so the occurrence of slack or the like of the ink ribbon 7, which is caused by rotation of the take-up ribbon core 6*a,* can be prevented while allowing the ribbon cassette 8 to be held. It is not likely that an ink-transferred portion of the ink ribbon 7 will be displaced to the printing area, and hence it is possible to surely prevent the occurrence of a printing error or the like. Besides, since it is possible to prevent the occurrence of slack or the like of the ink ribbon, it is also possible to prevent the ink ribbon from being caught in the ribbon cassette at the time of replacement of the ribbon cassette which would cause a malfunction of the printer.

Figure 24:
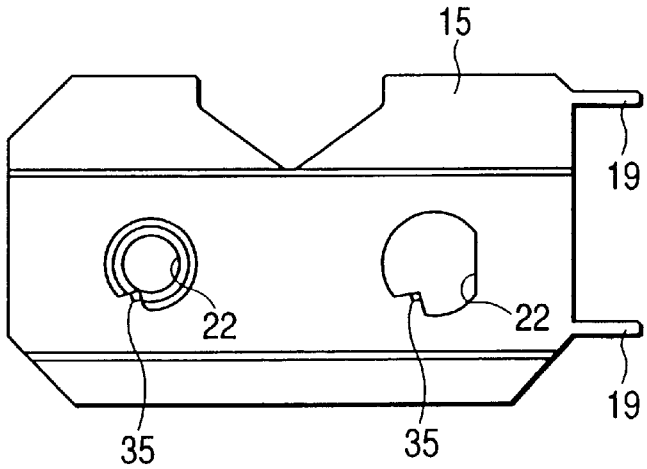
FIG. 24 is a plan view showing a cassette holder plate according to another embodiment of the present invention.
Figure 25:
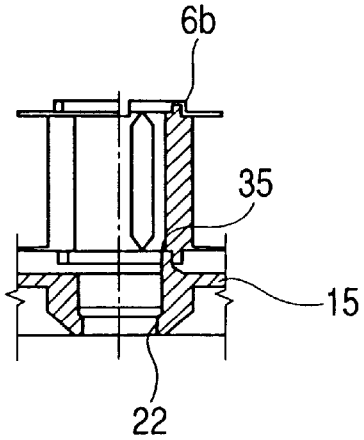
FIG. 25 is a sectional view of a delivery ribbon core portion, with a ribbon cassette held on the cassette holder plate shown in FIG. 24.
Figure 26:
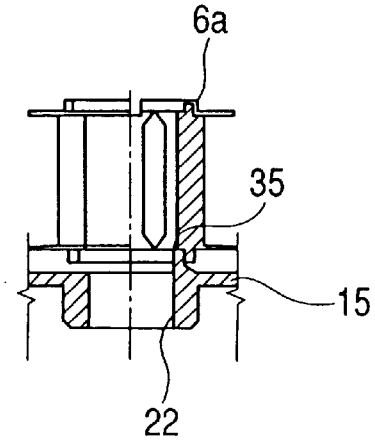
FIG. 26 is a sectional view of a take-up ribbon core portion, with a ribbon cassette held on the cassette holder plate shown in FIG. 24.

Referring to FIGS. 24 to 26, there is illustrated a cassette holder plate 15 according to another embodiment of the present invention. In this embodiment, swivel-stop bosses 35 are respectively formed on the peripheral edge portions of through holes 22 formed in the cassette holder plate 15. The other portions are the same as in the previous embodiment.

In this embodiment, when ribbon cassettes 8 are held in two stages, as to the upper-stage ribbon cassette, a first rib 29 formed on an extending portion 27 of a holding guide 21 is engaged between ribs 28 formed on the inner peripheral surface of a take-up ribbon core 6*a* of the ribbon cassette, whereby the ribbon core 6*a* is held so as not to rotate, as is the case with the previous embodiment.

As to the lower-stage ribbon cassette 8, first and second ribs 29, 30 of the holding guide 21 are engaged between ribs 28 of the take-up ribbon core 6*a* of the ribbon cassette and the swivel-stop bosses 35 are engaged respectively with the inner peripheral edges of the take-up ribbon core 6*a* and the delivery ribbon core 6*b* of the ribbon cassette 8, so that the take-up ribbon core and the delivery ribbon core are prevented from rotation.

In the case where only one-stage of a ribbon cassette 8 is held, not only the first rib 29 formed on the extending portion 27 of the holding guide 21 is engaged with ribs 28 of the take-up ribbon core 6*a* of the ribbon cassette 8, but also the swivel-stop bosses 35 are engaged with the inner peripheral edges of the take-up ribbon core 6*a* and the delivery ribbon core 6*b* of the ribbon cassette, whereby both cores 6*a* and 6*b* are held so as not to rotate.

Thus, in this embodiment the rotation of the take-up ribbon core 6*a* of the ribbon cassette 8 is prevented by the first and second ribs 29, 30 of the holding guide 21 and at the same time the rotation of the take-up ribbon core 6*a* and that of the delivery ribbon core 6*b* are prevented by the swivel-stop bosses 35, so that while the ribbon cassette 8 is held, the occurrence of slack or the like caused by rotation of the take-up ribbon core 6*a* can be surely prevented. Besides, since the rotation of the take-up ribbon core 6*a* is prevented, there is no fear that an ink-transferred portion of the ink ribbon 7 may be displaced to the recording area, whereby it is possible to surely prevent the occurrence of a printing error or the like. Further, it is possible to prevent the ink ribbon from being caught in the ribbon cassette 8 at the time of replacement of the same cassette which would cause a mal function.

The present invention is not limited to the above embodiments, but modifications may be made as necessary.

What is claimed is:

1. A thermal transfer printer comprising:

a carriage with a thermal head mounted thereon, said carriage being adapted to reciprocate along a platen;

a ribbon take-up mechanism for taking up an ink ribbon of a ribbon cassette loaded onto said carriage;

a holding cover disposed at a position opposed to said carriage;

a plurality of cassette holder plates for holding ribbon cassettes respectively, said cassette holder plates being arranged side by side on said holding cover on the side opposed to the ribbon cassette loading side of said carriage; and a carrier disposed on said carriage for the transfer and replacement of the ribbon cassettes between said cassette holder plates and said carriage, wherein a ribbon cassette containing an ink ribbon of a desired color is selected and loaded onto said carriage, said thermal head is driven in accordance with image information to effect a desired printing on a printing paper fed between said platen and said thermal head, said cassette holder plates can hold said ribbon cassettes stackedly in two stages, and the total number of the ribbon cassettes held on all said cassette holder plates is smaller by at least one than the total number of the ribbon cassettes capable of being held by the cassette holder plates.

2. A thermal transfer printer according to claim 1, wherein said cassette holder plates are movable vertically, and an urging means is provided for urging the cassette holder plates to the ribbon cassette loading side of said carriage at all times.

3. A thermal transfer printer according to claim 1, wherein:

a fixed holding arm for holding said ribbon cassettes is provided near one side of each of said cassette holder plates in a direction in which said plurality of cassette holders are arranged side by side, and a movable holding arm for pressing the ribbon cassettes to said fixed holding arm is provided near an opposing side of each of said cassette holder plates, respectively;

holding guides for two ribbon cores of the ribbon cassettes are erected on said holding cover so as to extend through the cassette holder plates at positions corresponding to the two ribbon cores of the ribbon cassettes;

a holding arm for holding an upper peripheral edge portion of one ribbon core of said ribbon cassette opposed to the ribbon cassette loading side of said carriage is formed integrally with one of said holding guides for each of said cassette holder plates; and a rib for engagement with a rib formed on an inner peripheral surface of a second ribbon core of said ribbon cassette is formed on said holding guide opposed to the holding guide having the holding arm for holding the upper peripheral edge portion.

4. A thermal transfer printer according to claim 3, wherein a tip of said fixed holding arm and a tip of the holding arm of the one holding guide are respectively formed with pawls for holding the ribbon cassette, said pawls projecting in a same direction, and the rib of the opposing holding guide is also projected in a same direction as the pawls of said fixed holding arm and said holding arm.

5. A thermal transfer printer according to claim 4, wherein the projecting direction of the tip of said fixed holding arm and that of the holding arm of the one holding guide and the projection direction of the rib of the other holding guide are made opposite to the pressing direction of said movable holding arm for the ribbon cassette.

6. A thermal transfer printer according to claim 5, wherein the rib of the other holding guide is engaged with the take-up core of the ribbon cassette.

* * * * *